United States Patent [19]

Leuchtenmüller

[11] Patent Number: 4,937,924

[45] Date of Patent: Jul. 3, 1990

[54] APPARATUS FOR NEEDLING A FELT FROM ONE SIDE

[75] Inventor: Rudolf Leuchtenmüller, Schwertberg, Austria

[73] Assignee: Textilmaschinenfabrik Dr. Ernst Fehrer Aktiengesellschaft, Leonding, Austria

[21] Appl. No.: 350,563

[22] Filed: May 11, 1989

[30] Foreign Application Priority Data

May 17, 1988 [AT] Austria ..... 1276/88

[51] Int. Cl.[5] ..... D04H 18/00

[52] U.S. Cl. ..... 28/107; 28/108; 28/110; 28/111

[58] Field of Search ..... 28/107, 108, 109, 110, 28/111, 113, 115, 163

[56] References Cited

U.S. PATENT DOCUMENTS

| | | | |
|---|---|---|---|
| 3,409,959 | 11/1968 | Barboni | 28/108 X |
| 4,035,881 | 7/1977 | Zocher | 28/111 |
| 4,378,618 | 4/1983 | Dilo | 28/110 |

FOREIGN PATENT DOCUMENTS 351280 7/1979 Austria .

*Primary Examiner*—Werner H. Schroeder
*Assistant Examiner*—Bradley K. DeSandro
*Attorney, Agent, or Firm*—Kurt Kelman

[57] ABSTRACT

In order to ensure a desirable withdrawal of the felt in an apparatus for needling a felt from one side, the stripper plate (3) is provided on that side which faces the support (2) for the felt with guide ribs (7), which extend between the longitudinal rows of holes (4) and protrude from the underside surface of the plate and have a height amounting to 0.2 to 2 times the diameter of the holes.

2 Claims, 2 Drawing Sheets

APPARATUS FOR NEEDLING A FELT FROM ONE SIDE

BACKGROUND OF THE INVENTION

1. Field of the Invention

This invention relates to an apparatus for needling a felt from one side, comprising at least one needle board, which is movable up and down, and a stripper plate, which is provided between a support for the felt and the needle board and is formed with holes for the passage of the needles, which are arranged in longitudinal rows extending in the direction of travel of the felt.

2. Description of the Prior Art

As the needles penetrate into the felt, fibers will be forced against the needle shanks and part of said fibers may be carried along by the needles as they are pulled out of the felt. As a result, that surface portion of the felt which is adjacent to the holes in the stripper plate may be bulged into said holes. Owing to the large number of needles this will considerably increase the resistance to the withdrawl of the felt so that excessively high loads will be incurred and the penetration frequency which can be achieved will be limited particularly if an operation at a high penetration frequency will result in vibration of the stripper plate and the take-off rollers.

If spaced apart blades extending in the direction of travel of the felt are used instead of a perforate stripper plate and the needles move between said blades, it will be possible to avoid an increase of the resistance to the withdrawal of the felt. But such stripper blades cannot take up such high loads as perforate stripper plates.

For an operation in which loop-forming needles penetrate into a non-woven web from mutually opposite sides it is known (Austrian Patent Specification No. 351,280) to associate a perforate guide plate with each side of the web and to provide said guide plate with grooves, which extend in the direction of travel of the web. The needles are bifurcate and are received by said grooves when said needles have penetrated through the web to form loops. That known apparatus cannot be used to needle a non-woven web only from one side but can be used to process only a preneedled web and the provision of the known grooves will result in the critical disadvantage that said needles will be soiled very quickly so that they become clogged and this may adversely affect the operability of the apparatus.

SUMMARY OF THE INVENTION

It is an object of the invention to avoid these disadvantages and to provide an apparatus which is of the kind described first hereinbefore and which is so improved with simple means that the penetration frequency can be increased without a risk of an excessively high load.

The object set forth is accomplished in accordance with the invention in that the stripper plate is provided on that side which faces the support for the felt with guide ribs, which extend between the longitudinal rows of holes and protrude from the underside surface of the plate and have a height amounting to 0.2 to 2 times the diameter of the holes.

Because the felt is held back by the guide ribes of the stripper plate and said guide ribs protrude from the surface of the plate by an adequate distance, the surface of the felt which bulges between the guide ribs as the needles are pulled out of the felt cannot enter the holes through which the needles pass. As a result, the felt can be moved between the support for the felt and the stripper plate by means of withdrawing rollers and the resistance to the withdrawal of the felt will not periodically be increased because the guide ribs extend between the rows of holes along the longitudinal rows of needles in the direction of travel of the felt and do not resist the withdrawal of the felt portions disposed between the guide ribs. In dependence on the possible bulging of the surface of the felt the height of said guide ribs must be so large that an entrance of fibers into the opening of the holes through which the needles pass will be avoided. Because the needle density should be as high as possible and the guide ribs should be sufficiently strong, the spacing of the guide ribs will generally correspond to the diameter of the holes. The height of the possible bulge of the surface of the felt will depend on the diameter of the holes and on the spacing of the guide ribs. It has been found in practice that a lower limit of the height of the guide ribs is 0.2 times the hole diameter and that said height will be sufficient to ensure that the resistance to the withdrawal of the felt will be substantially constant. But the height of the ribs cannot be increased as much as desired because this may result in a soiling of the recesses formed between the ribs. If the height of the ribs is at an upper limit corresponding to twice the hole diameter, an adequate cleaning action of the felt in the recesses between the guide ribs will be ensured. For that purpose a design in which the height of the guide ribs is one-half to one diameter of the holes will be particularly advantageous.

Because guide ribs having a defined height are arranged between adjacent rows of holes in the stripper plate, the penetration frequency will not be limited by the inevitable bulging of the surface of the felt as the needles are pulled out of the felt. Nevertheless, the penetration frequency will not be limited by the inevitable bulging of the surface of the felt as the needles are pulled out of the felt. Nevertheless the risk of a damage to the stripper plate by needles which have been broken out or bent will be low because the guide ribs have a comparatively small height and owing to the stripper plate have an adequate strength, which would not be achieved if individual guide blades were provided.

DETAILED DESCRIPTION OF THE PREFERRED EMBODIMENT

Figure 1:
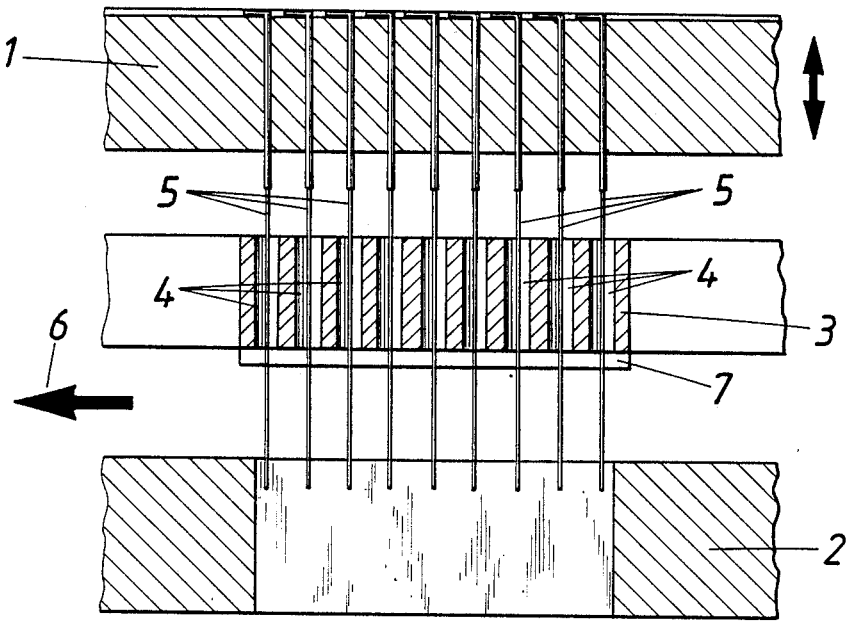
FIG. 1 is a diagrammatic vertical sectional view showing an apparatus in accordance with the invention for needling a felt.
Figure 2:
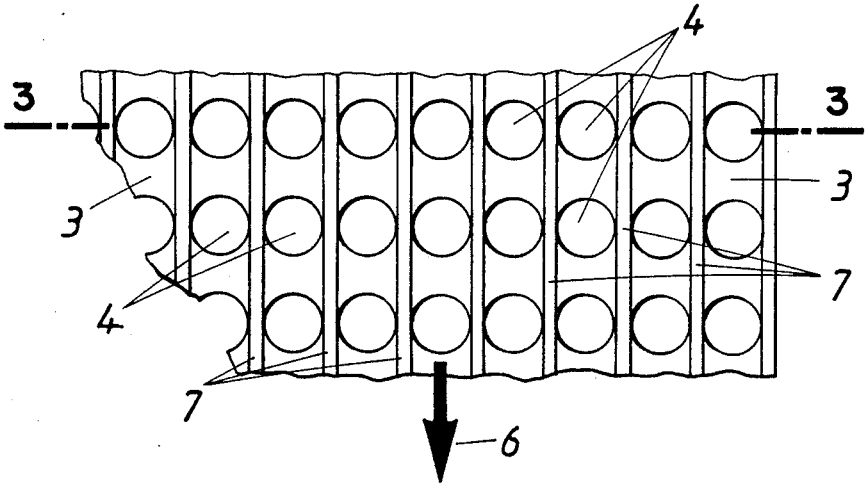
FIG. 2 is an enlarged view of that surface of the stripper plate of that apparatus which faces the felt.
Figure 3:
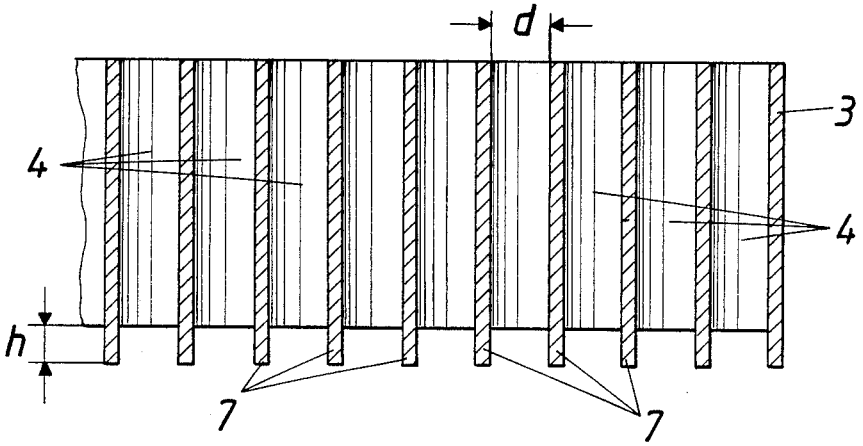
FIG. 3 is a sectional view taken on line 3—3 in FIG. 2.

An illustrative embodiment of the invention will now be described in detail with reference to the drawing.

As is apparent from FIG. 1 the illustrated apparatus essentially consists of a needle board 1, which is driven to move up and down, e.g., by an eccentric drive, a support 2 for the felt, which support consists of a bed plate composed of blades, and a stripper plate 3, which is disposed between the needle board 1 and the felt support 2 and is formed with holes 4 for the passage of respective needles 5 of the needle board 1. The needles 5 of the needle board 1 are arranged in longitudinal rows, which extend in the direction of travel 6 of the felt. During the working stroke of the needle board 1 the needles 5 penetrate through the felt, which is moved by withdrawing rollers, not shown, between the felt support 2 and the stripper plate 3. As a result of said penetration, fiber loops are formed in the fibrous structure to increase the coherence of the fibers. As the needles 5 are pulled out, the felt is held back relative to the needles 5 by the stripper plate 3. As a result of said penetration, fiber loops are formed in the fibrous structure to increase the coherence of the fibers. As the needles 5 are pulled out, the felt is held back relative to the needles 5 by the stripper plate 3.

As the needles are pulled out, the surface of the felt is bulged. To prevent that bulging surface of the felt from entering the mouths of the holes 4 in the stripper plate 3, the stripper plate 3 is provided on its underside surface, which faces the support 2 for the felt with parallel guide ribs 7, which are disposed between adjacent longitudinal rows of holes 4 and extend in the direction of travel 6 of the felt. As a result, as the needles 5 are pulled out the felt will be substantially held back by said guide ribs rather than by the entire underside surface of the stripper plate 3, which surface is set back from said guide ribs. The height h of the guide ribs 7 is about 0.2 to 2 times the diameter d and preferably to one-half of one diameter d of the holes 4. Owing to said size relations the surface of the felt which bulges at least close to the needles 5 as they are pulled out cannot enter the mouths of the holes 4 so that the resistance to the withdrawal of the felt will remain constant. But the height of the guide ribs 7 is not so large that the recesses formed between the guide ribs 7 may be soiled. This will be prevented by the fact that the bulging surface of the felt will clean the recesses as far as to the underside surface of the perforate plate. For that purpose, ribs having a height between 2.5 and 3.5 mm have proved satisfactory in conjunction with usual hole diameters.

I claim:

1. In an apparatus for needling a felt from one side, comprising a support for supporting a felt for a movement in a predetermined direction of travel, a needle board, which is arranged to be movable up and down over said support and carries a multiplicity of needles, which depend from said needle board toward said support and are arranged in a plurality of longitudinal rows extending in said direction of travel, and a stripper plate, which is disposed between said support and said needle board and has an underside surface and is formed with a multiplicity of holes, which are arranged in a plurality of longitudinal rows extending in said direction of travel and permit said needles to pass through respective ones of said holes as said needle board is moved up and down, the improvement residing in that said stripper plate is provided with a plurality of guide ribs, which protrude from said underside surface and each of which extends in said direction of travel between adjacent ones of said longitudinal rows of holes and said ribs have a height which is 0.2 to 2 times the diameter of said holes.

2. The improvement set forth in claim 1, wherein said ribs have a height which is one-half to one diameter of said holes.

* * * * *